US012790782B1

(12) United States Patent
Lacey

(10) Patent No.: US 12,790,782 B1
(45) Date of Patent: Nov. 10, 2026

(54) SNOW REMOVER

(71) Applicant: Gregory W. Lacey, Edgemont, SD (US)

(72) Inventor: Gregory W. Lacey, Edgemont, SD (US)

( * ) Notice: Subject to any disclaimer, the term of this patent is extended or adjusted under 35 U.S.C. 154(b) by 222 days.

(21) Appl. No.: 18/894,049

(22) Filed: Sep. 24, 2024

(51) Int. Cl.
*E01H 5/10* (2006.01)
*E01H 10/00* (2006.01)

(52) U.S. Cl.
CPC ..... *E01H 5/108* (2013.01); *E01H 10/007* (2013.01)

(58) Field of Classification Search
CPC ..... E01H 5/108; E01H 5/104; E01H 5/106; E01H 5/06; E01H 5/10; E01H 5/102; E01H 5/12; E01H 5/045; E01H 10/007
See application file for complete search history.

(56) References Cited

U.S. PATENT DOCUMENTS 2,977,955 A 4/1961 Altenburg
4,033,055 A 7/1977 Lazarecky
6,595,200 B1 7/2003 Dai
7,231,140 B2 6/2007 Dolton, III
8,428,446 B1 4/2013 Pimentel
10,066,352 B2 9/2018 Rogers
11,649,599 B1 5/2023 Fuentes
2009/0282707 A1 11/2009 Shenouda
2010/0313451 A1 12/2010 Trubiano
2017/0152639 A1* 6/2017 Cho ..... E01H 5/106
2018/0044870 A1 2/2018 Soni et al.
2020/0370258 A1* 11/2020 Noland ..... E01H 5/108

* cited by examiner

*Primary Examiner* — Robert E Pezzuto
(74) *Attorney, Agent, or Firm* — Cramer Patent & Design, PLLC.; Aaron R. Cramer

(57) ABSTRACT

The present invention relates to a snow and ice removal device designed for use with yard power equipment, such as a garden tractor. The device addresses the problem of effectively melting and removing snow and ice from paved surfaces while preventing re-freezing of the melted water. The solution involves a snow melting system featuring an upper spray bar with nozzles, a suction head with a heated jacket, and a high-pressure water pump for circulating heated water. The device also includes a water system with primary and secondary holding tanks, a flash water heater, and an electrical power system powered by a battery and inverter, ensuring efficient operation and disposal of collected water. The device is intended for use in maintaining clear, safe surfaces in residential and commercial areas.

10 Claims, 2 Drawing Sheets

SNOW REMOVER

RELATED APPLICATIONS

Not applicable.

FIELD OF THE DEVICE

The presently disclosed subject matter is directed to a snow and ice removal device that integrates with yard power equipment, such as garden tractors. The device is specifically designed to melt and remove snow and ice from paved surfaces, ensuring that the resultant water is effectively managed to prevent re-freezing, thus maintaining clear and safe conditions in both residential and commercial environments.

BACKGROUND OF THE DEVICE

Snow and ice accumulation on driveways, walkways, parking lots, and other paved surfaces can create significant safety hazards, particularly in regions that experience severe winter conditions. Slippery surfaces increase the risk of falls and accidents, posing dangers to pedestrians and vehicles alike. Traditional snow removal methods, such as manual shoveling, snow blowers, or the application of salt and de-icing chemicals, are commonly used but often come with several drawbacks. Manual methods can be physically demanding and time-consuming, making them impractical for large areas or frequent snowfall. Mechanical devices like snow blowers can clear snow but do not address the problem of ice formation or the refreezing of melted snow, which can lead to persistent hazards.

Moreover, the widespread use of salt and chemical de-icers has environmental consequences, including soil degradation, water pollution, and damage to concrete and vegetation. These methods also require repeated application, particularly during prolonged cold spells, adding to their cost and environmental impact. Additionally, while powered snow removal devices exist, they typically focus on mechanical clearing by physically moving or pushing the snow aside. These devices often lack an integrated system for melting snow and managing the resultant meltwater, which can refreeze and create ice patches, necessitating further treatment or removal.

There is a clear need for a more comprehensive solution that not only removes snow and ice effectively but also prevents the re-freezing of the melted water, thereby enhancing safety and reducing the need for repeated treatments. The ideal device would be easy to operate, environmentally friendly, and capable of integrating with existing yard power equipment, such as garden tractors, making it accessible to a wide range of users, including homeowners and commercial property managers. This device would provide a more efficient, sustainable, and long-lasting approach to managing winter weather conditions on paved surfaces.

SUMMARY OF THE DEVICE

Embodiments of the present disclosure may include a snow and ice removal device, featuring yard power equipment comprising a chassis, at least one wheel, a seat, a steering wheel, and an engine. Embodiments may also include a power system operatively connected to the engine, the power system comprising a drive shaft, a main drive pulley, and upper and lower drive belts.

In some embodiments, the upper drive belt may be connected to a propulsion drive system that provides forward and reverse motion to the yard power equipment, while the lower drive belt may be connected to a high-pressure water pump. Embodiments may also include a snow melting system mounted on the front of the yard power equipment, the snow melting system comprising an upper spray bar equipped with a plurality of nozzles, a supply line connected to the nozzles for delivering heated water, a suction head for collecting melted snow and ice, and a suction line comprising an inner hose and an outer heated jacket to prevent the refreezing of collected water.

Embodiments may also include a water system comprising a primary holding tank for storing water and a fuel source for powering a flash water heater. In some embodiments, the flash water heater heats the water supplied to the upper spray bar through the supply line. Additionally, the suction line may return the collected water to the primary holding tank.

In some embodiments, excess water may be directed to a secondary holding tank through an overflow line. Embodiments may also include an electrical power system comprising a battery and an inverter. In some embodiments, the battery may be charged by the engine, and the inverter converts the battery's output to alternating current (AC) power. The AC power may then be used to operate the flash water heater and at least one vacuum motor for providing suction power to the suction head.

In some embodiments, the engine may be selected from the group consisting of an internal combustion engine and an electric motor. The heated jacket of the suction line may be powered by the heated water supplied from the flash water heater. The secondary holding tank may include a secondary drain valve for releasing excess water to a suitable location.

In some embodiments, the snow and ice removal device may include a primary drain valve for emptying the primary holding tank to prevent freezing of the water within the primary holding tank. Additionally, the at least one vacuum motor may be positioned atop the primary holding tank and operatively connected to the suction head to provide suction power.

In some embodiments, the yard power equipment may be configured similarly to a lawn mower or garden tractor. The snow and ice removal device may include a support frame for mounting the suction head to the yard power equipment. The fuel source may be a propane tank, and the propulsion drive system may be operatively connected to the at least one wheel to provide forward and reverse motion to the chassis.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
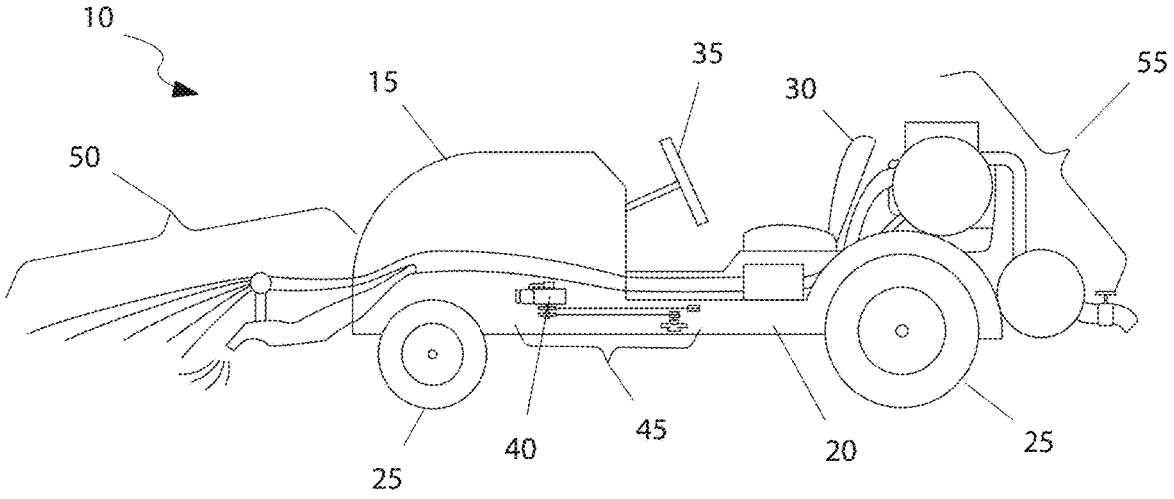
FIG. 1 is a side sectional view of the snow and ice removal device 10, according to the preferred embodiment of the present invention.

10 snow and ice removal device
15 yard power equipment
20 chassis
25 wheel
30 seat
35 steering wheel
40 engine
45 power system
50 snow melting system
55 water system
60 electrical power system
65 drive shaft
70 main drive pulley
75 drive belt
80 propulsion drive system
85 high pressure water pump
90 upper spray bar
95 nozzle
100 supply line
105 suction head
110 support frame
115 suction line
120 inner hose
125 heated jacket
130 fuel source
135 flash water heater
140 water
145 primary holding tank
150 secondary holding tank
155 secondary drain valve
160 primary drain valve
165 vacuum motor
170 overflow line
175 battery
180 inverter

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a side sectional view of the snow and ice removal device 10, according to the preferred embodiment of the present invention is disclosed. The snow and ice removal device (herein also described as the "device") 10, is configured to melt the snow and the collects the resultant water 140 for subsequent disposal. The device 10 utilizes a yard power equipment 15, similar in nature to a similar to a lawn mower or garden tractor. The exact size, style and type of yard power equipment 15 is not intended to be a limiting factor of the present invention. The yard power equipment 15 is provided with customary amenities including but not limited to: a chassis 20, at least one (1) wheel 25, a seat 30, a steering wheel 35, and an engine 40. It is noted that the engine 40 may be an internal combustion engine, an electric motor, or similar prime driver. The exact type of engine 40 is not intended to be a limiting factor of the present invention. The device 10 is also provided with a power system 45, a snow melting system 50, a water system 55 and an electrical power system 60 (not shown in this view due to illustrative limitations, all of which are used to melt and remove snow and ice. Further description of the detail and operation of the power system 45, the snow melting system 50, the water system 55, and the electrical power system 60 will be provided herein below.

Figure 2:
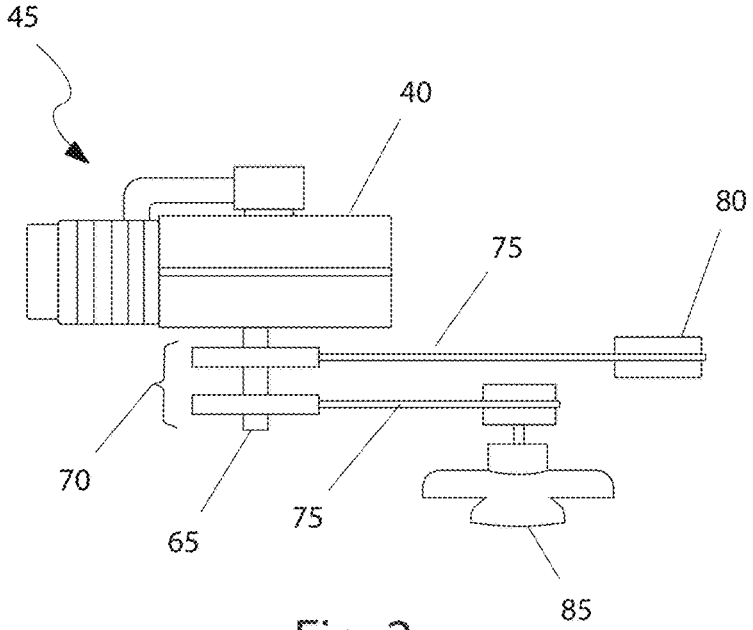
FIG. 2 is a detailed view of the power system 45 as used with the snow and ice removal device 10, according to the preferred embodiment of the present invention.

Referring next to FIG. 2, a detailed view of the power system 45 as used with the device 10, according to the preferred embodiment of the present invention is depicted. The power system 45 contains the engine 40 that provides the prime mover force in the form of rotational energy. A drive shaft 65 from the engine 40 drives a main drive pulley 70. The main drive pulley 70 then provides rotational energy to two (2) drive belts, an upper and a lower drive belt 75. The upper drive belt 75 drives a propulsion drive system 80 which provides forward and reverse motion of the chassis 20 via wheels 25 (shown in FIG. 1). The lower drive belt 75 provides rotation power to a high-pressure water pump 85, which aids the device 10 in removal of snow and ice, which will be shown in greater detail herein below.

Figure 3:
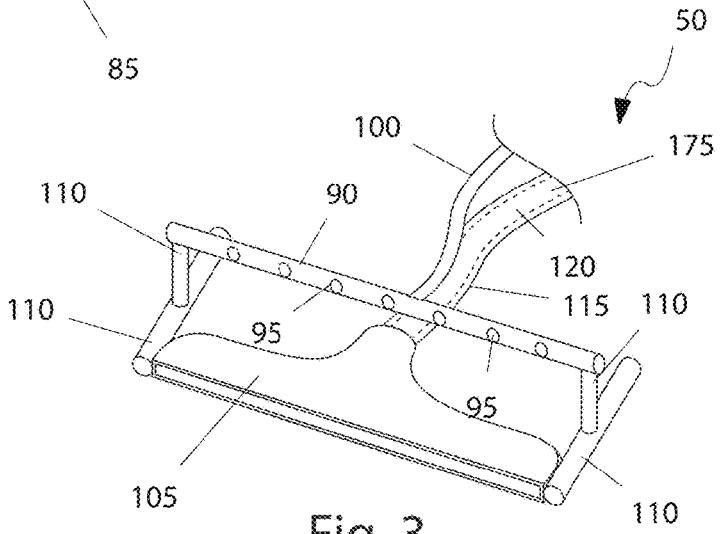
FIG. 3 is a detailed view of the snow melting system 50 as used with the snow and ice removal device 10, according to the preferred embodiment of the present invention.

Referring now to FIG. 3, a detailed view of the snow melting system 50 as used with the device 10, according to the preferred embodiment of the present invention is shown. The snow melting system 50 is configured to be mounted on the front of the yard power equipment 15 (as shown in FIG. 1) where the user can visually ascertain proper operation. The snow melting system 50 provides for an upper spray bar 90 provided with a plurality of nozzles 95. The nozzles 95 are fed a source of heated water by a supply line 100. The supply line 100 is connected to a suction head 105 by a support frame 110. Water 140 is then removed from the suction head 105 by a suction line 115, comprising an inner hose 120 to remove the melted snow and ice, as well as an outer heated jacket 125 (herein shown by a dashed line due to its hidden nature) to prevent the water 140 from the melted snow and ice from refreezing.

Figure 4:
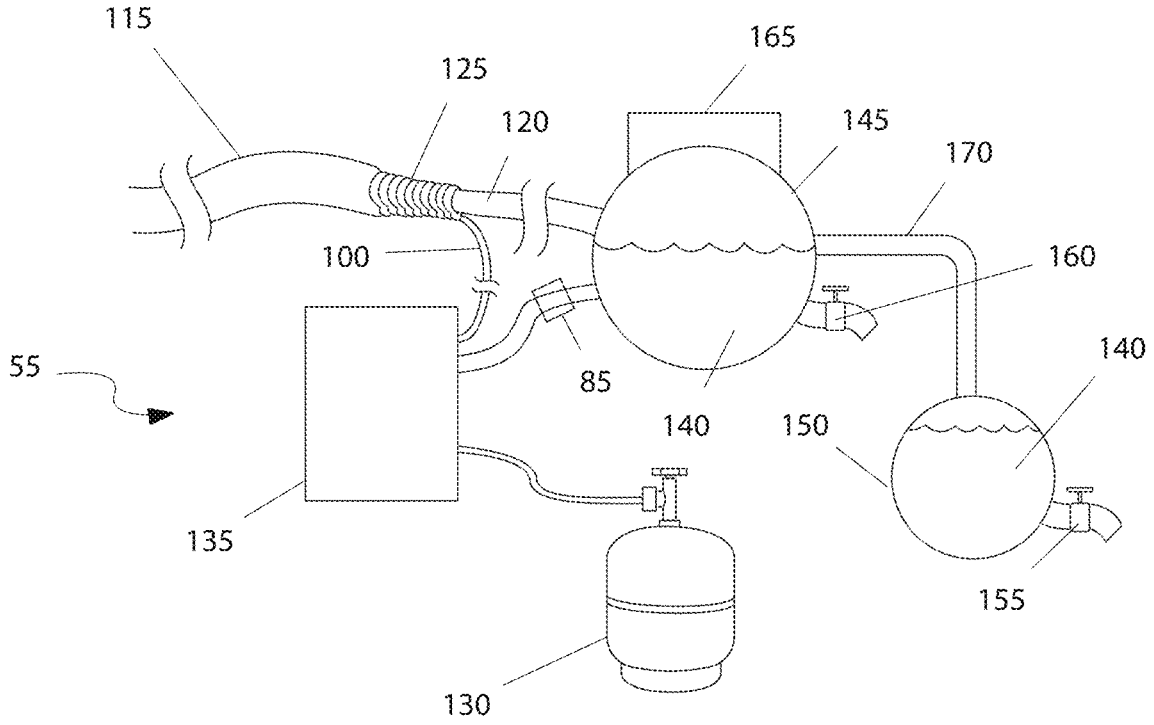
FIG. 4 is a detailed view of the water system 55 as used with the snow and ice removal device 10, according to the preferred embodiment of the present invention; and, FIG. 5 is a detailed view of the electrical power system 60 as used with the snow and ice removal device 10, according to the preferred embodiment of the present invention.

Referring next to FIG. 4, a detailed view of the water system 55 as used with the snow and ice removal device 10, according to the preferred embodiment of the present invention is disclosed. The water system 55 provides the equipment necessary to produce the heated water 140 to melt the snow and ice through the upper spray bar 90 (as shown in FIG. 3) as well as remove the melted snow and ice via the suction head 105 (as shown in FIG. 3). A fuel source 130, herein depicted as a propane tank, provides fuel to a flash water heater 135. Water 140 is obtained from a primary holding tank 145, pressurized by the high-pressure water pump 85, heated by the flash water heater 135 and then delivered via the supply line 100. The supply line 100 is also used to heat the heated jacket 125, as part of the suction line 115. The inner hose 120 then delivers the returned water 140 to the primary holding tank 145 where it is recirculated as needed. During operation, excess water 140, is routed to a secondary holding tank 150. When the secondary holding tank 150 becomes full, a secondary drain valve 155 is used to empty the secondary holding tank 150 to a suitable location such as a drain, ditch, curb, or the like. At the end of use, a primary drain valve 160 is used to empty the primary holding tank 145 in a similar manner to prevent freezing of the water 140 inside of the primary holding tank 145. One (1) or more vacuum motors 165 are located atop the primary holding tank 145 to provide the suction power for the suction head 105 (as shown in FIG. 3). An overflow line 170, under gravity operation, allows for the flow of water from the primary holding tank 145 to the secondary holding tank 150.

Figure 5:
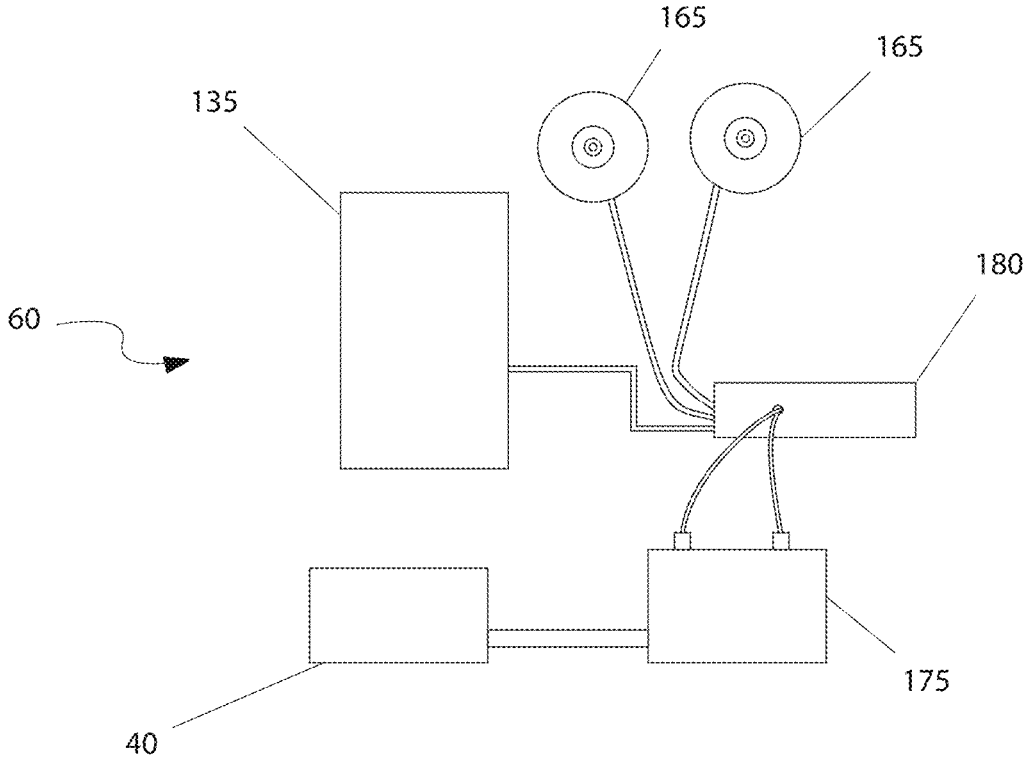

Referring to FIG. 5, a detailed view of the electrical power system 60 as used with the device 10, according to the preferred embodiment of the present invention is depicted. A battery 175 receives charging power from the engine 40 in a customary manner through an alternator or other means. The battery 175 then provides power to an inverter 180 which converts the direct current (DC) output of the battery 175 to alternating current (AC) power. The output of the inverter 180 is then used to power any electrical accessories on the flash water heater 135 as well as power one (1) or more vacuum motors 165.

In an alternative embodiment, the snow and ice removal device 10 "consists of" all of the numbered elements specifically enumerated within this specification. This embodiment is characterized by its inclusion of a yard power equipment 15 that features a chassis 20, at least one wheel 25, a seat 30, a steering wheel 35, and an engine 40, all operating in conjunction with a power system 45, a snow melting system 50, a water system 55, and an electrical power system 60. The power system 45 includes a drive shaft 65 connected to a main drive pulley 70, which transmits rotational energy via upper and lower drive belts 75 to the propulsion drive system 80 and a high-pressure water pump 85. The snow melting system 50, mounted on the front of the yard power equipment 15, uses an upper spray bar 90 with nozzles 95, supplied by heated water from the water system 55, which is stored in a primary holding tank 145 and circulated by the high-pressure water pump 85 through a supply line 100 and a suction line 115 featuring an inner hose 120 and a heated jacket 125. The electrical power system 60 is powered by a battery 175, which is charged by the engine 40 and converted to alternating current by an inverter 180, ensuring the operation of the flash water heater 135 and the vacuum motors 165. This configuration facilitates efficient snow and ice removal by melting the snow and simultaneously collecting the resultant water 140, which is stored and managed within the primary and secondary holding tanks 145, 150 for proper disposal. This embodiment reflects a fully integrated system that ensures the device's efficacy and reliability in snow and ice removal operations.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as hardware stores, home improvement stores, mechanical supply houses, mail order and internet supply houses and the like. Special attention would be paid to overall size and configuration of the yard power equipment 15 such that it is properly sized for the intended use.

After procurement and prior to utilization, an initial supply of water 140 would be added into the primary holding tank 145 to allow for initial operation. The flash water heater 135 would be started with electrical power from the inverter 180 and fuel from the fuel source 130, and the engine 40 would be started. At this point in time, the device 10 is ready for use.

During utilization of the device 10, the user would sit in the seat 30 of the yard power equipment 15 and drive it using the steering wheel 35 in the same manner as other powered yard equipment. The engine 40 would propel the yard power equipment 15 while also operating the high-pressure water pump 85. High pressure heated engine 40 would be emitted from the nozzles 95 on the upper spray bar 90 as supplied by the supply line 100. As the contacted snow and ice melts, it is immediately suctioned up by the suction head 105 and through the inner hose 120 of the suction line 115 and heated by the heated jacket 125 to prevent re-freeing. Subject melted engine 40 is suctioned by the vacuum motors 165 and deposited into the primary holding tank 145. The melted water 140 may be reused by the snow melting system 50 in a repeating manner. Any excess water 140 is routed via gravity through the overflow line 170 to the secondary holding tank 150. When the secondary holding tank 150 becomes full, it is emptied by the secondary drain valve 155 to a suitable location such as curb, drain, or ditch. Operation then continues in a repeating and cyclical manner.

After use of the device 10, any remaining water 140 in the primary holding tank 145 and the secondary holding tank 150 is removed by the primary drain valve 160 and the secondary drain valve 155 respectively. All components of the device 10 are de-energized, and the device 10 is stored until needed again. In such a manner, not only is all snow and ice melted from paved surfaces, but the resulting melt water 140 is completely removed without worry of re-freezing at the sides of walkways, driveways, parking lots or roadways.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A snow and ice removal device, comprising:

a yard power equipment comprising a chassis, at least one wheel, a seat, a steering wheel, and an engine;

a power system operatively connected to the engine, the power system comprising a drive shaft, a main drive pulley, and an upper and lower drive belt, wherein the upper drive belt is connected to a propulsion drive system that provides forward and reverse motion to the yard power equipment, and the lower drive belt is connected to a high-pressure water pump;

a snow melting system mounted on a front of the yard power equipment, the snow melting system comprising an upper spray bar provided with a plurality of nozzles, a supply line connected to the nozzles for delivering heated water, a suction head for collecting melted snow and ice, and a suction line comprising an inner hose and an outer heated jacket to prevent refreezing of a collected water;

a water system comprising a primary holding tank for storing water, a fuel source for powering a flash water heater, wherein the flash water heater heats the water supplied to the upper spray bar through the supply line, and wherein the suction line returns the collected water to the primary holding tank, and wherein excess water is directed to a secondary holding tank through an overflow line; and, an electrical power system comprising a battery and an inverter, wherein the battery is charged by the engine and the inverter converts the battery's output to alternating current (AC) power, and wherein the AC power is used to operate the flash water heater and at least one vacuum motor for providing suction power to the suction head.

2. The snow and ice removal device of claim 1, wherein the engine is selected from the group consisting of an internal combustion engine and an electric motor.

3. The snow and ice removal device of claim 1, wherein the heated jacket of the suction line is powered by the heated water supplied from the flash water heater.

4. The snow and ice removal device of claim 1, wherein the secondary holding tank further comprises a secondary drain valve for releasing excess water to a suitable location.

5. The snow and ice removal device of claim 1, further comprising a primary drain valve for emptying the primary holding tank to prevent freezing of water within the primary holding tank.

6. The snow and ice removal device of claim 1, wherein the at least one vacuum motor is positioned atop the primary holding tank and is operatively connected to the suction head to provide suction power.

7. The snow and ice removal device of claim 1, wherein the yard power equipment is configured to be similar in nature to a lawn mower or garden tractor.

8. The snow and ice removal device of claim 1, further comprising a support frame for mounting the suction head to the yard power equipment.

9. The snow and ice removal device of claim 1, wherein the fuel source is a propane tank.

10. The snow and ice removal device of claim 1, wherein the propulsion drive system is operatively connected to the at least one wheel to provide forward and reverse motion to the chassis.

* * * * *